US012378789B2

(12) United States Patent
Harden et al.

(10) Patent No.: US 12,378,789 B2
(45) Date of Patent: Aug. 5, 2025

(54) SYSTEMS AND METHODS FOR POOL FRAME CONNECTORS

(71) Applicant: Belgravia Wood Limited, Hong Kong (HK)

(72) Inventors: Daniel Kendall Harden, Carmel-by-the-Sea, CA (US); Wayman Lee, Los Altos, CA (US); Elliot Lucas Ortiz, San Francisco, CA (US)

(73) Assignee: Belgravia Wood Limited, Central (HK)

( * ) Notice: Subject to any disclaimer, the term of this patent is extended or adjusted under 35 U.S.C. 154(b) by 192 days.

(21) Appl. No.: 18/250,352

(22) PCT Filed: Oct. 25, 2021

(86) PCT No.: PCT/US2021/072016

§ 371 (c)(1),
(2) Date: Apr. 24, 2023

(87) PCT Pub. No.: WO2022/087639

PCT Pub. Date: Apr. 28, 2022

(65) Prior Publication Data

US 2024/0018795 A1 Jan. 18, 2024

Related U.S. Application Data

(60) Provisional application No. 63/198,507, filed on Oct. 23, 2020.

(51) Int. Cl.
*E04H 4/00* (2006.01)

(52) U.S. Cl.
CPC ..... *E04H 4/0056* (2013.01)

(58) Field of Classification Search
CPC ..... E04H 4/0056; E04H 4/0018
USPC ..... 4/488
See application file for complete search history.

(56) References Cited

U.S. PATENT DOCUMENTS

| | | | | |
|---|---|---|---|---|
| 5,054,135 | A | 10/1991 | Dallaire et al. | |
| 6,643,858 | B2 | 11/2003 | Lee | |
| 11,149,454 | B1 * | 10/2021 | Andrews | E04H 4/108 |
| 2017/0356206 | A1 | 12/2017 | Huang | |

(Continued)

FOREIGN PATENT DOCUMENTS

WO WO-2020/058854 A1 3/2020

OTHER PUBLICATIONS

International Search Report for PCT International Application No. PCT/US2021/072016 dated Dec. 10, 2021 (3 pages).

*Primary Examiner* — Huyen D Le
(74) *Attorney, Agent, or Firm* — Finnegan, Henderson, Farabow, Garrett & Dunner, L.L.P.

(57) ABSTRACT

Disclosed are systems and methods for connecting frame members and beams of a pool. A frame member may be configured to connect to a first beam and a second beam via a connector. The connector may include a recessed portion to mate within one or more of the first beam, the second beam, and/or the frame member. The connector may include a pin to fix the position of at least one of the first beam, the second beam, and/or the frame member. The connector may include internal structures such as an integral support or a support protrusion for structural stability. The connector may include an accessory mount. The connector may include a light source.

20 Claims, 7 Drawing Sheets

(56) References Cited

U.S. PATENT DOCUMENTS

| | | | | |
|---|---|---|---|---|
| 2018/0149342 | A1 | 5/2018 | Lan et al. | |
| 2019/0178275 | A1 | 6/2019 | Lin et al. | |
| 2020/0149570 | A1 | 5/2020 | Huang et al. | |
| 2020/0332544 | A1* | 10/2020 | Huang | E04H 4/0056 |
| 2022/0307279 | A1* | 9/2022 | Ramos | F16B 7/0486 |
| 2023/0323692 | A1* | 10/2023 | Ramos | E04H 4/0056 4/506 |

* cited by examiner

SYSTEMS AND METHODS FOR POOL FRAME CONNECTORS

CROSS REFERENCES TO RELATED APPLICATIONS

This application is the National Phase of PCT International Application No. PCT/US2021/072016, filed on Oct. 25, 2021, which claims the benefit of U.S. Provisional Application No. 63/198,507 filed on Oct. 23, 2020. The entire contents of the above-referenced applications are incorporated herein by reference.

FIELD

The present disclosure relates generally to pool structures, including apparatus, systems, and methods for installing pool structures.

BACKGROUND

An above ground pool is constructed from various pool structures. Such pool structures include a pool frame that supports a pool liner and contains water within and/or around the pool frame and provides the support to hold water against the weight of the water, the liner, and any apparatus associated with maintaining and using the above ground pool. Certain pool structures such as frame components may be used to hold other structures in a particular configuration, and those structures may be difficult to assemble while providing the necessary structural support.

These pool structures may be used to form the pool frame of an above-ground pool. The above ground pool, in particular, may take advantage of avoiding the cost and effort involved with digging or otherwise excavating a space for a pool. Above-ground pools may take advantage of being installed in locations where digging or excavating is impracticable or impossible. Pool frames for above ground pools are heavy and difficult to transport effectively. Thus, it is desired to have a pool frame that is easily installable, is secure against the weight of the water and/or other apparatus associated with maintenance and/or use of the pool, and where the installation is efficient and repeatable. It is also desired to have an aesthetically pleasing above-ground pool that may include lights in frame pieces. It is also desired to provide an attachment mechanism to frame members for mounting of pool accessories for a number of games, cover, or entertainment items.

SUMMARY

According to some embodiments consistent with the present disclosure, a frame for a pool may be installed as a series of beams and generally vertical frame members. According to some embodiments, one or more beams may be configured to connect to one or more generally vertical frame members to form the frame of the pool. According to some embodiments, a frame member may be configured to connect to a first beam and a second beam via a connector. According to some embodiments, the connector may include a recessed portion to mate within one or more of the first beam, the second beam, and/or the frame member. According to some embodiments, the connector may include a pin to fix the position of at least one of the first beam, the second beam, and/or the frame member.

According to some embodiments, a pool frame connector may comprise a first portion including a support protrusion wherein the first portion includes a clip, and a second portion including a support receptacle. According to some embodiments, the first portion may be configured to hold against the second portion via the clip and the support protrusion of the first portion may be configured to fit within the support receptacle.

According to some embodiments, a pool frame connector may comprise a first portion including a support protrusion wherein the first portion includes a clip, and a second portion include a recessed portion corresponding to the clip. According to some embodiments, the pool frame connector may comprise an accessory support protruding from the first portion and the second portion wherein the first portion holds against the second portion via the clip to hold the accessory support.

According to some embodiments, a pool frame connector may comprise a first portion including a support protrusion wherein the first portion includes a clip, a second portion, and a light. According to some embodiments, the second portion may include a recessed portion corresponding to the clip, and the second portion may include a part configured to be translucent. According to some embodiments, the light may be connected to an internal portion of at least one of the first portion or the second portion that transmits light through the part. According to some embodiments, the first portion may hold against the second portion via the clip.

DETAILED DESCRIPTION

Reference will now be made in detail to exemplary embodiments, some examples of which are shown in the accompanying drawings.

Exemplary disclosed embodiments include apparatus, systems, and methods for a pool frame including pool structures. The pool frame may include a first beam, a second beam, and a frame member. The first beam and the second beam may connect to the frame member via a connector. The connector may be configured to hold the fame member relative to the first beam and the second beam against a weight of water, a pool liner, and/or an apparatus for maintaining or using a pool. For example, in some embodiments, a pool liner may be installed within a volume within the pool frame. The liner may include a polymer that extends below and around a volume of water. The liner may be connected to the frame to contain the water. The water may be used for a variety of reasons including, for example, recreation. The frame may form a shape to contain water within the shape. In some embodiments, the shape of the frame may be circular. The disclosed embodiments provide for a secure, replicable installation of the pool frame.

Although vertical frame members are described herein, a variety of frame members are contemplated that are not limited to strictly vertical orientations. For example, frame members may be at an angle from vertical and connect to beams in a number of orientations. It is contemplated that frame members may be triangular. It is contemplated that frame members may include diagonal supports. It is contemplated that frame members and/or beams may be circular or elliptical.

Figure 1:
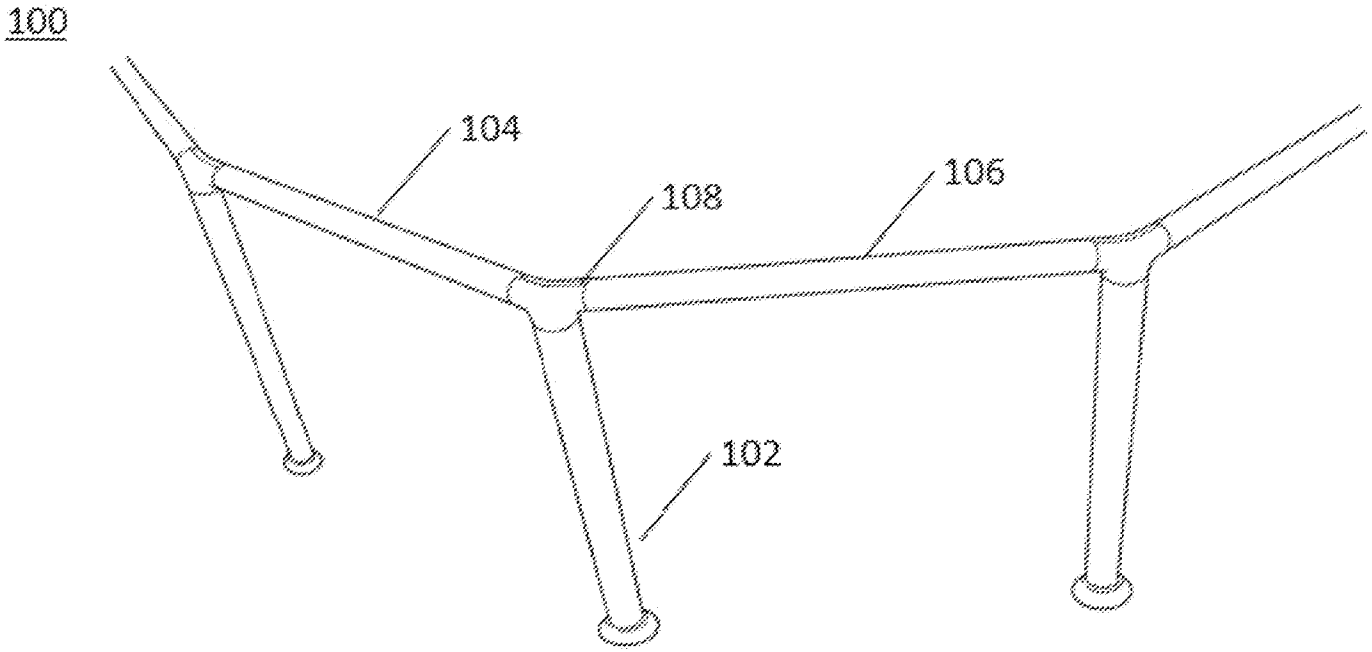
FIG. 1 illustrates an exemplary embodiment of a portion of a pool frame.
Figure 4:
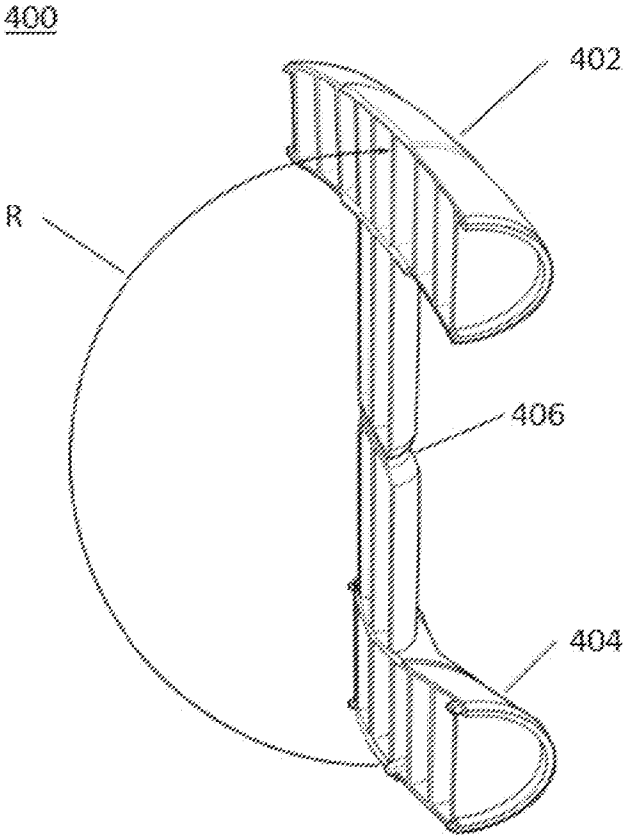
FIG. 4 illustrates an exemplary embodiment of a pool frame connector.
Figure 5:
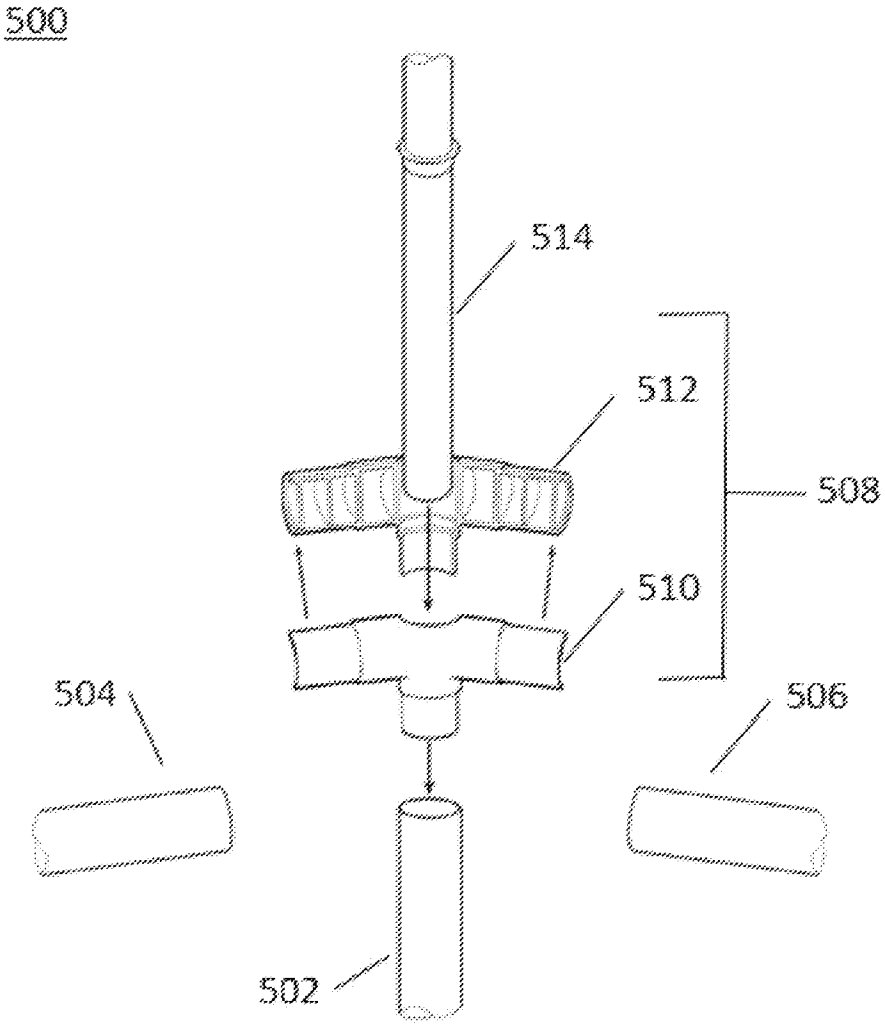
FIG. 5 illustrates an exemplary embodiment of a portion of a pool frame.
Figure 6:
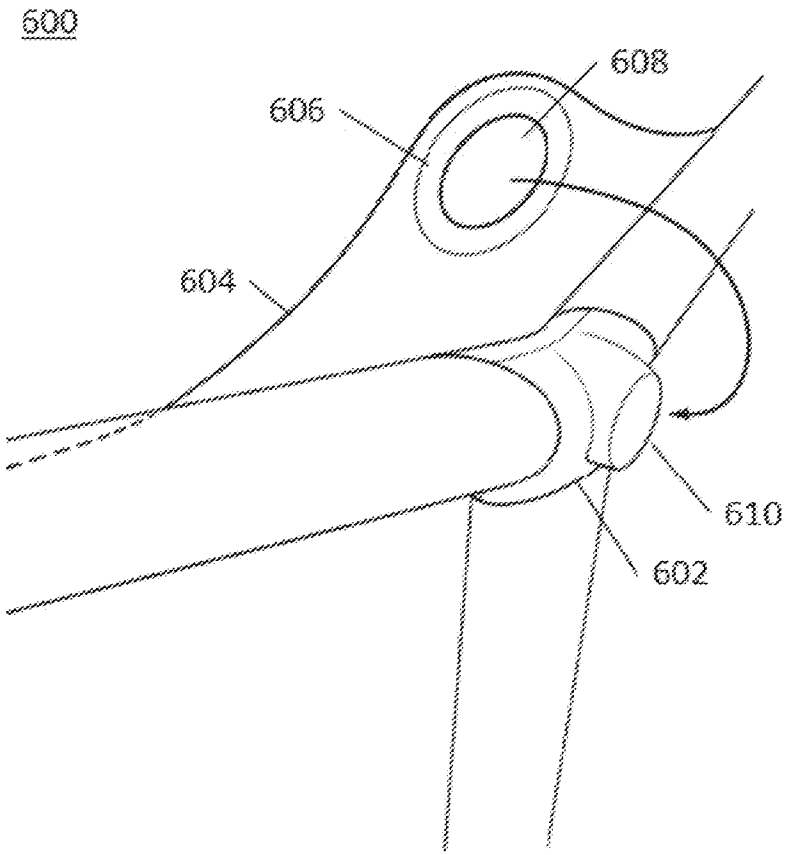
FIG. 6 illustrates an exemplary embodiment of a portion of a pool frame.

FIGS. 1, 5, and 6 illustrate non-limiting examples of a portion of a pool frame consistent with the present disclosure. FIGS. 2, 3A-3B, and 4 illustrate non-limiting examples of a pool frame connector. It is understood that the examples and embodiments described represent simplified descriptions used to facilitate understanding of the principles and methods of this disclosure.

FIG. 1 illustrates an exemplary embodiment of pool frame 100. Pool frame 100 may include frame member 102, first beam 104, second beam 106, and connector 108. Frame member 102 may include a generally vertical frame to transfer a portion of the weight of a pool to the ground. Frame member 102 may stand by itself, with the support of other frame members, or it may be connected to a floor surface by being buried, being bolted to a floor connecting member, or being encased in concrete. The weight of first beam 104 and second beam 106 and a pool liner containing water may be transmitted to frame member 102 via connector 108.

Additional frame members, beams, and connectors may be used to form a circumference of a pool. The number of frame members, beams, and connectors may be adjusted to increase or decrease the size of the pool, and frame members and beams may be interchangeable to allow for replicable installation.

Figure 2:
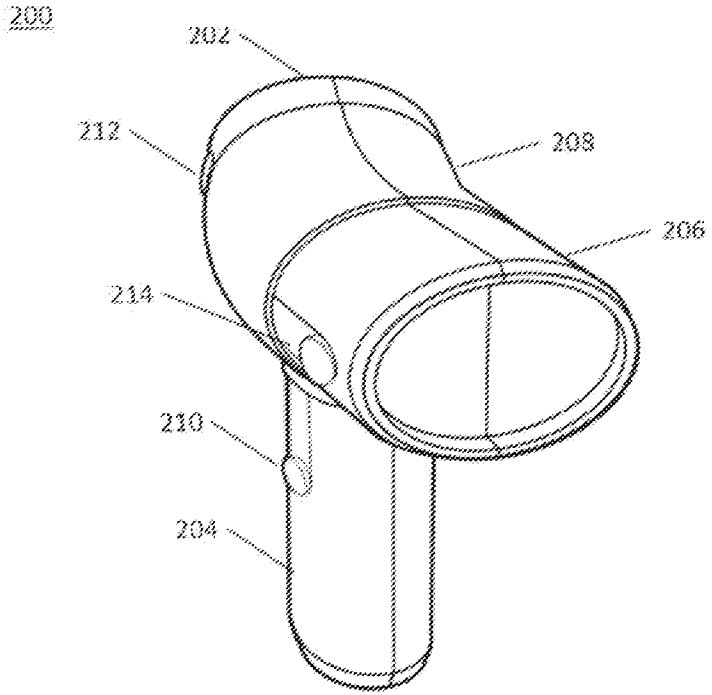
FIG. 2 illustrates an exemplary embodiment of a pool frame connector.

FIG. 2 shows an exemplary embodiment of connector 200. Certain features of connector 200 are not shown or discussed in these examples where such features may be similar to those discussed for other embodiments. Connector 200 may include a first end 202, a second end 204, a third end 206, and a raised portion 208. First end 202 may be configured to mate to a portion of a beam (e.g., first beam 104) via a press fit, threaded, or adhesive connection. Second end 204 may be configured to mate to a portion of another beam (e.g., second beam 106) via a press fit, threaded, or adhesive connection. Third end 206 may be configured to mate to a portion of a frame (e.g., frame member 102). Ends 202, 204, and 206 may include a recessed portion to fit within a mating frame or beam. First end 202 may include first pin 212 to lock to a hole or recessed portion within a beam. Second end 204 may include second pin 210 to lock to a hole or recessed portion within another beam. Third end 206 may include third pin 214 to lock to a hole or recessed portion within a frame member. Raised portion 208 may mate against an end of one or more beams and/or frame members. In some embodiments, raised portion 208 may be at a level with first beam 104, second beam 106, and/or frame member 102 so as to form a substantially continuous surface.

Figure 3B:
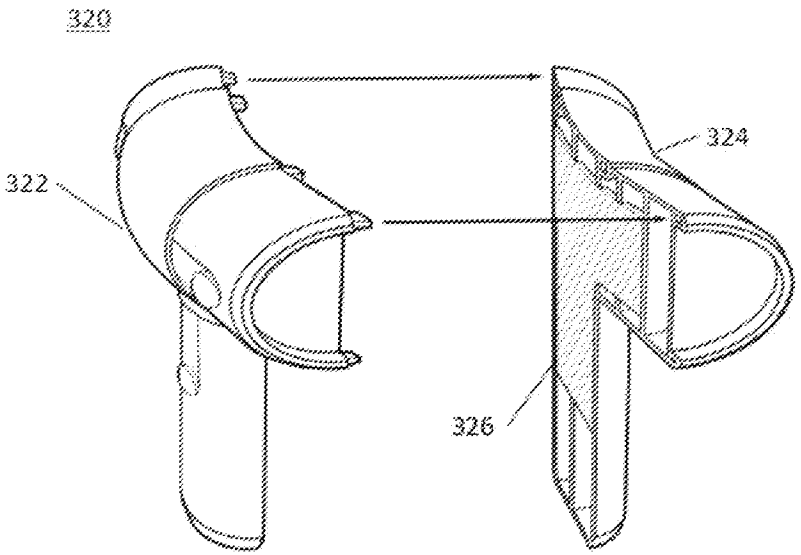
FIGS. 3A-3B illustrate exemplary embodiments of a pool frame connector.
Figure 3A:
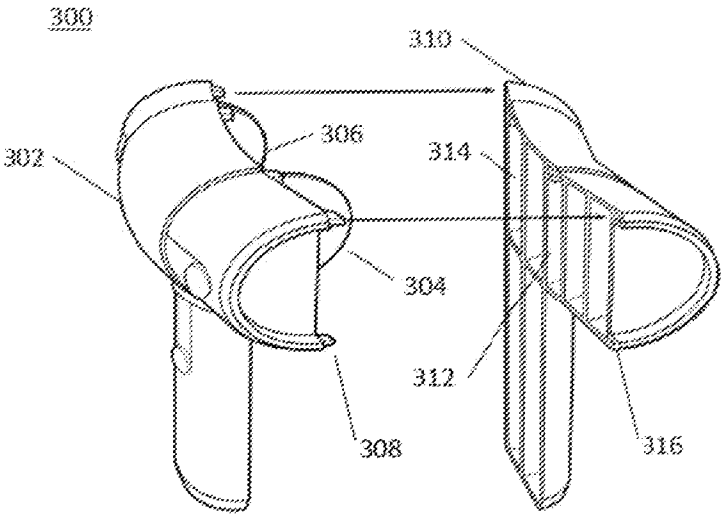

FIGS. 3A-3B illustrate exemplary embodiments of a connector. FIG. 3A illustrates an exemplary embodiment of connector 300. Certain features of connector 300 are not shown or discussed in these examples where such features may be similar to those discussed for other embodiments.

Connector 300 may include first portion 302 and second portion 310. First portion 302 may include at least one insert such as insert 308. The at least one insert may be near an edge of an end portion (e.g., first end 202) for access and ease of assembly. The at least one insert may comprise a number of inserts near the edge of first portion 302 so as to provide a structural connection when first portion 302 is connected with second portion 310.

Second portion 310 may include receptacles that correspond to inserts (e.g., insert 308) of first portion 302. For example, second portion 310 may include receptacle 316 that corresponds to insert 308. Inserts, such as insert 308, and receptacles, such as receptacle 316, may be used to mate first portion 302 to second portion 310. A connection between such inserts and receptacles may be a press fit connection. For a press fit connection, one or more recesses may be provide to allow a user to insert a leverage tool to disconnect the inserts and receptacles. In some embodiments, a connection between such inserts and receptacles may be a pinned connection or a clip connection. For a clip connection, one or more holes may allow access to the clip so that the clip can be disconnected.

Second portion 310 may include at least one support recession that corresponds to the at least one support protrusions of first portion 302. For example, first portion 302 may include at least one support protrusion such as support protrusion 304 and support protrusion 306, and the at least one support recession may include corresponding first support recession 312 and second support recession 314. Support protrusions 304, 306 may mate against internal surfaces of a raised portion (e.g, raised portion 208) to provide structural support to first portion 302 mated to second portion 310. In some embodiments, internal surfaces of the raised portion may be curved so as to mate against curved surfaces of support protrusions 304, 306. One or more of flat surfaces of first and second protrusions 304, 306 may mate against one or more of flat surfaces of support recessions 312, 314.

In some embodiments, first portion 302 and second portion 310 may be configured to form a seal. The seal may prevent water from entering an internal portion of the connector. The seal may include an adhesive, a rubber, tightly connecting components, and/or a press fit. In some embodiments, internal structure may form a seal (e.g., support protrusions 304, 306 against an internal surface of the second portion 310).

FIG. 3B illustrates an exemplary embodiment of connector 320. Certain features of connector 320 are not shown or discussed in these examples where such features may be similar to those discussed for other embodiments.

Connector 320 may include first portion 322, second portion 324, and integral support 326. Integral support 326 may be affixed to at least one of first portion 322 and second portion 324 via a welded, pinned, threaded, adhesive, or press fit connection. In some embodiments, integral support 326 may include a metal, where the metal is stamped, cast, extruded, and/or welded. In some embodiments, integral support 326 may include a glass filled nylon.

Integral support 326 may be configured to provide structural support. For example, integral support 326 may be disposed along a portion of a length and height of connector 320. In some embodiments, integral support 326 may at least partially extend from a first region near a first end (e.g., first end 202) to a second region near a second end (e.g., second end 206). Integral support 326 may substantially extend from one or more of the first end and the second end towards a third region near the third end (e.g., third end 204). Integral support 326 may be formed in a t-shape. an integral support configured to span a portion of the distance between a first end and a second end, wherein the integral support is configured to span a portion of the distance between a third end and a level of the first end and the second end. In some embodiments, integral support 326 may be disposed along a first area of the first portion that mates against a second area of the second portion when a clip of the first portion is within a recess of the second portion.

Integral support 326 may be formed from a single piece of material. In some embodiments, integral support 326 may be constructed from multiple components bound, attached, or installed together. Integral support 326 may be configured to transmit load from pool beams (e.g., beams 104, 106) to a substantially vertical frame member (e.g., frame member 102).

In some embodiments, first portion 322 and second portion 324 may each include an integral support (e.g., integral support 326). In some embodiments, the integral support of first portion 322 may mate against the integral support of second portion 324 when first portion 322 is mated against second portion 324 (e.g., inserts, such as insert 308, are mated within receptacles, such as receptacle 316). In some embodiments, the integral support of first portion 322 may be adhesively connected to the integral support of second portion 324.

FIG. 4 illustrates an exemplary embodiment of connector 400. Certain features of connector 400 are not shown or discussed in these examples where such features may be similar to those discussed for other embodiments.

Pool frame 400 may include first portion 402 and second portion 404. First portion 402 and second portion 404 may rotate about joint 406 to such that an inward portion of first portion 402 mates against an inward portion of second portion 404. Joint 406 may include a rotatable connection. At least one of first portion 402 and second portion 404 may rotate about joint 406. As an example, second portion 404 may rotate in direction R to mate against first portion 402 (e.g., inserts, such as insert 308, are mated within receptacles, such as receptacle 316).

FIG. 5 illustrates an exemplary embodiment of pool frame 500. Certain features of pool frame 500 are not shown or discussed in these examples where such features may be similar to those discussed for other embodiments.

Pool frame 500 may include frame member 502, first beam 504, second beam 506, and connector 508. Connector 508 may include first portion 510 and second portion 512. Connector 508 may include accessory support 514. For example, accessory support 514 may extend upward from first and second portions 510, 512. In some embodiments, accessory support 514 may extend outward from first and second portions 510, 512. In some embodiments, accessory support 514 may comprise a tube.

First portion 510 and second portion 512 may be configured to mate against each other via a number of protrusions, a press fit, a clip, and/or an adhesive. Connector 508 may connect to frame member 502 via one or more of a press fit connection, an adhesive connection, or a welded connection. Connector 508 may connect to first beam 504 via one or more of a press fit connection, an adhesive connection, or a welded connection. Connector 508 may connect to second beam 506 via one or more of a press fit connection, an adhesive connection, or a welded connection. In some embodiments, second portion 512 may include accessory support 514. In some embodiments, accessory support 514 may fit within frame member 502 and first and second portions 510, 512 may mate against each other around accessory support 514.

In some embodiments, accessory support 514 may be integrally formed with second portion 512. In some embodiments, accessory support 514 may be press fit into a combination of first portion 510 and second portion 512.

Where connector 508 may include one or more integral supports (e.g., integral support 326) as discussed with reference to FIG. 3B, the integral support may form a recess that accessory support 514 fits within.

Accessory support 514 may be configured to support a portion of the weight of one or more accessories. Accessory support 514 mated to connector 508 and first beam 502 can allow the weight of the one or more accessories to be transferred to the ground. In some embodiments, the one or more accessories may be used for recreation. In such embodiments, the accessories may include an umbrella, a screen, a speaker, a sports goal, a pool roof, a support for mosquito netting, a torch, a bug deterrent, a cupholder, a table, or a light.

FIG. 6 illustrates an exemplary embodiment of a portion of pool frame 600. Certain features of pool frame 600 are not shown or discussed in these examples where such features may be similar to those discussed for other embodiments.

Pool frame 600 may include connector 602. Connector 602 may include a protrusion 610 that is configured to hold pool liner 604 in a position. For example, pool frame 600 may include a plurality of connectors 602 around a shape of an above ground pool where each connector of the plurality of connectors includes protrusions to mount pool liner 604. Pool liner 604 may include reinforcement 606 and aperture 608. Protrusion 610 may fit within aperture 608 to hold pool liner 604. The weight of pool liner 604 may be at least partially transmitted by connector 602 to a frame member (e.g., frame member 502). In some embodiments, connector 602 may be configured to maintain the connection of pool liner 604 to connector 602. In some embodiments, connector 602 may include a cap that holds against protrusion 610 and/or connector 602, where the cap is connected via at least one of a welded connection, a threaded connection, a press fit connection, a clip, or a pinned connection. In such embodiments, the cap may hold the pool liner 604 against connector 602 and/or protrusion 610.

In some embodiments, connector 602 may include an accessory mount (e.g., mount 514). In such embodiments, protrusion 610 may be to a first side of the accessory mount and/or a second protrusion may be to a second side of the accessory mount. In some embodiments, where protrusion 610 is centered on connector 602, a pool liner (e.g., pool liner 604) may be configured to connect around the accessory mount by a fastener such as a zippered connection, clasps, or buttons.

Figure 7:
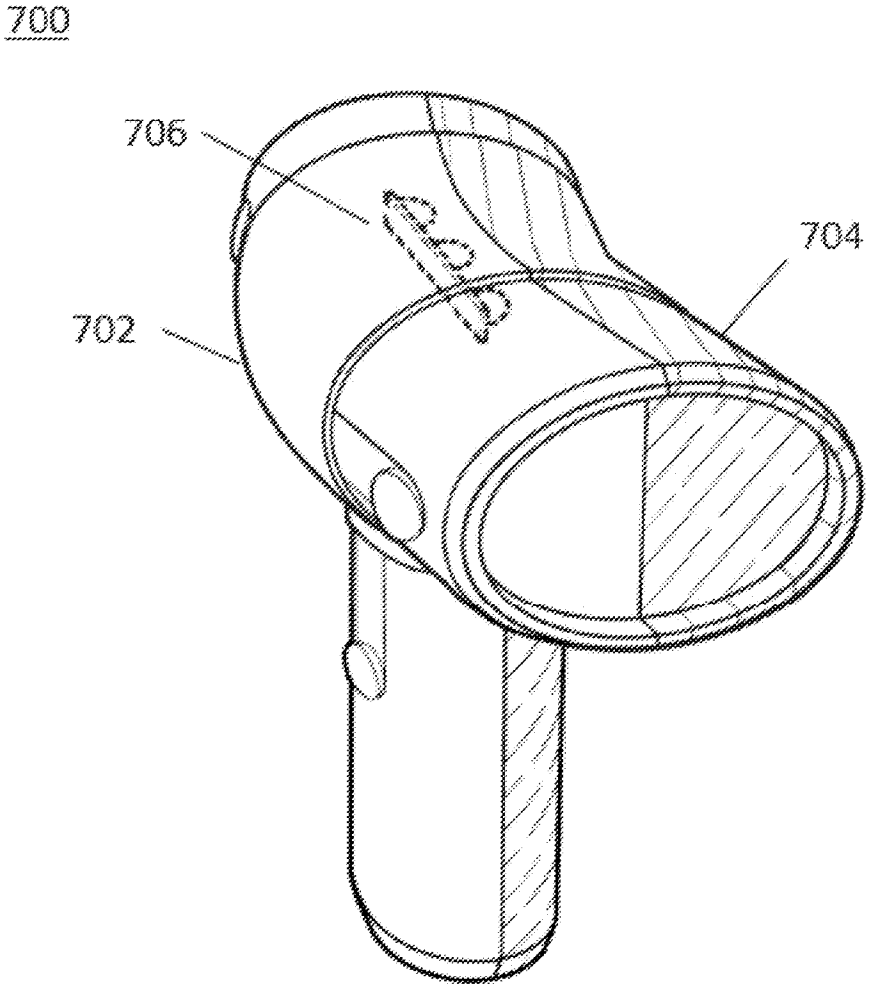
FIG. 7 illustrates an exemplary embodiment of a pool frame connector.

FIG. 7 illustrates an exemplary embodiment of connector 700. Certain features of connector 700 are not shown or discussed in these examples where such features may be similar to those discussed for other embodiments.

FIG. 7 may include connector 700. Connector 700 may include first portion 702 and second portion 704. Second portion 704 may include a part configured to be translucent. For example, second portion 704 may include a segment configured to be translucent to transmit light towards water within a pool such as to light the pool and/or an area above the pool. First portion and/or second portion 704 may include a translucent plastic. First portion 702 and/or second portion 704 may include sections made of an opaque plastic to selectively transmit light in a direction. For example, a connector may include one or more protrusion portions (e.g., protrusion portions 304, 306) that is opaque and an integral support (e.g., integral support 326) that is opaque, a second portion that is translucent, and the light source 706 may be mounted on the integral support and between protrusion portions such that light is directed internal to the pool, for example, by the integral support and protrusion portions.

In some embodiments, first portion 702 and second portion 704 may be configured to form a seal to keep water and/or debris from light source 706. In some embodiments, light source 706 may be waterproof.

In some embodiments, a pool liner (e.g., pool liner 604) to the inside of connector 700 may include a part configured to be translucent or include apertures, such that the pool liner transmits light. In some embodiments, first portion 702 may be configured to block light from extending towards an outward portion of a pool. For example, first portion 702 may include a part configured to be opaque or semi-opaque. In some embodiments, first portion 702 may include a section configured to be translucent. For example, first portion 702 may include a section configured to be translucent and transmit light towards a ground outside a pool.

Connector 700 may include light source 706. Light source 706 may be connected to an internal portion of connector 700. In embodiments where light source 706 is connected to the internal portion of connector 700, a protrusion (e.g., protrusion 610), an internal structure (e.g., an inside of protrusion 610, protrusion portions 304, 306, structural members within a first portion or a second portion, or integral support 326) and/or a cap, as discussed with reference to FIG. 6, may each include a part configured to be translucent to transmit light. Light source 706 may be connected to a support (e.g., accessory support 514) or an internal portion of first portion 702 or second portion 704 (e.g., an inside of protrusion 610, protrusion portions 304, 306, structural members within a first portion or a second portion, or integral support 326). Light source 706 may include an LED or a series of LEDs. In some embodiments, light source 706 may include a battery within connector 700 for powering light source 706.

In some embodiments, light source 706 may be configured to be powered by an energy source external to connector 706. In some embodiments, light source 706 may be wired to other components and the wires may traverse an interior of 700 through openings of internal structures. In some embodiments, the wiring may be sealed where it passes from connector 706, for example to one or more beams and/or frame members, to prevent water and/or debris from entering an interior of connector 700.

It is understood that while certain embodiments are discussed to facilitate understanding of various principles and aspects of this disclosure, the embodiments are not described in isolation and the descriptions are not necessarily mutually exclusive. Thus, it is contemplated and understood that described features of principles of any embodiment may be incorporated into other embodiments.

It will be apparent to those skilled in the art that various modifications and variations can be made to the disclosed pool, pool liner, frame members, and connections. While illustrative embodiments have been described herein, the scope of the invention includes any and all embodiments having equivalent elements, modifications, omissions, combinations (e.g., of aspects across various embodiments), adaptations and/or alterations as would be appreciated by those skilled in the art based on the present disclosure. The limitations in the claims are to be interpreted broadly based on the language employed in the claims and not limited to examples described in the present specification or during the prosecution of the application, which examples are to be construed as non-exclusive. It is intended, therefore, that the specification and examples be considered as exemplary only, with a true scope and spirit of the invention being indicated by the following claims and their full scope of equivalents.

The invention claimed is:

1. A pool frame connector comprising:

a first portion comprising a support protrusion and a clip, and a second portion configured to connect to the first portion, wherein the second portion comprises a support receptacle and a recession, wherein the first portion holds against the second portion by the clip fitting into the recession, and wherein the support protrusion of the first portion fits within the support receptacle of the second portion to mate against an internal surface of the second portion.

2. The pool frame connector of claim 1, further comprising a first end configured to fit within a beam, wherein the first end comprises a pin for holding the beam in position.

3. The pool frame connector of claim 1, further comprising a raised portion between a first end and a second end, wherein the raised portion forms a substantially continuous surface with a first beam attached at the first end and a second beam attached at the second end.

4. The pool frame connector of claim 1, further comprising an integral support configured to span a portion of the distance between a first end and a second end, wherein the integral support is configured to span a portion of the distance between a third end and a level of the first end and the second end.

5. The pool frame connector of claim 1, further comprising an integral support disposed along a first area of the first portion that mates against a second area of the second portion when the clip is fitted into the recession.

6. The pool frame connector of claim 1, further comprising a light, wherein the first portion is substantially opaque and the second portion is configured to allow light to pass.

7. The pool frame connector of claim 1, further comprising a protrusion for mounting a pool liner.

8. The pool frame connector of claim 1, further comprising an accessory support configured to extend outward from the first portion and the second portion.

9. The pool frame connector of claim 1, wherein the first portion and the second portion forms a seal.

10. A pool frame connector comprising:

a first portion comprising a clip, a second portion configured to connect to the first portion, wherein the second portion comprises a recessed portion corresponding to the clip, and an accessory support configured to extend outward from the first portion and the second portion, wherein the first portion holds against the second portion by the clip fitting into the recession, wherein the accessory support is held between the first portion and the second portion.

11. The pool frame connector of claim 10, further comprising a first end configured to fit within a beam, wherein the first end comprises a pin for holding the beam in position.

12. The pool frame connector of claim 10, further comprising a raised portion between a first end and a second end, wherein the raised portion forms a substantially continuous surface with a first beam attached at the first end and a second beam attached at the second end.

13. The pool frame connector of claim 10, further comprising an integral support configured to span a portion of the distance between a first end and a second end, wherein the integral support is configured to span a portion of the distance between a third end and a level of the first end and the second end, and wherein the integral support fits around the accessory support.

14. The pool frame connector of claim 10, further comprising a light, wherein the first part is substantially opaque and the second part is configured to allow light to pass.

15. The pool frame connector of claim 10, further comprising a protrusion for mounting a pool liner.

16. A pool frame connector comprising:

a first portion comprising a clip, a second portion comprising a recession corresponding to the clip, wherein the second portion includes an external surface area configured to be translucent, and a light source connected to an internal portion of at least one of the first portion or the second portion that transmits light through the external surface area, wherein the first portion holds against the second portion by the clip fitting into the recession.

17. The pool frame connector of claim 16, further comprising an integral support configured to span a portion of the distance between a first end and a second end, wherein the integral support is configured to span a portion of the distance between a third end and a level of the first end and the second end, and wherein the integral support fits around the accessory support.

18. The pool frame connector of claim 17, wherein the integral support is substantially opaque.

19. The pool frame connector of claim 16, wherein the first portion comprises a support protrusion configured to fit within a support receptacle of the second portion, and wherein the support receptacle is substantially opaque to direct light from the light source.

20. The pool frame connector of claim 16, wherein light from the light source is directed towards the ground.

* * * * *